US007033137B2

(12) United States Patent
Shufeldt

(10) Patent No.: US 7,033,137 B2
(45) Date of Patent: Apr. 25, 2006

(54) VORTEX BLOWER HAVING HELMHOLTZ RESONATORS AND A BAFFLE ASSEMBLY

(75) Inventor: Joel B. Shufeldt, Palenville, NY (US)

(73) Assignee: Ametek, Inc., Kent, OH (US)

( * ) Notice: Subject to any disclaimer, the term of this patent is extended or adjusted under 35 U.S.C. 154(b) by 68 days.

(21) Appl. No.: 10/805,156

(22) Filed: Mar. 19, 2004

(65) Prior Publication Data

US 2005/0207883 A1 Sep. 22, 2005

(51) Int. Cl.
*F04D 29/66* (2006.01)

(52) U.S. Cl. ..... 415/119; 415/211.2; 416/185; 416/234; 416/229 R

(58) Field of Classification Search ..... 415/55.2–55.4, 415/119, 211.2; 416/185, 234, 500, 229 R
See application file for complete search history.

(56) References Cited

U.S. PATENT DOCUMENTS

| | | | |
|---|---|---|---|
| 353,994 | A | 12/1886 | Walker et al. |
| 1,502,903 | A | 7/1924 | Campbell |
| 1,868,008 | A | 7/1932 | Gardner |
| 1,893,184 | A | 1/1933 | Smellie |
| 1,983,606 | A | 12/1934 | Geise |
| 2,097,205 | A | 10/1937 | Cary et al. |
| 2,098,640 | A | 11/1937 | Cary |
| 2,171,341 | A | 8/1939 | McMahan |
| 2,225,398 | A | 12/1940 | Hamblin |
| 2,951,632 | A | 9/1960 | Hanson |
| 3,006,603 | A | 10/1961 | Caruso et al. |
| 3,058,528 | A | 10/1962 | Hiersch |
| 3,398,866 | A | 8/1968 | Flame et al. |
| 3,437,173 | A | 4/1969 | Ehrich |
| 3,819,007 | A | 6/1974 | Wirt et al. |
| 3,819,009 | A | 6/1974 | Motsinger |
| 3,820,628 | A | 6/1974 | Hanson |
| 3,844,674 | A | 10/1974 | Moriyama |
| 3,849,024 | A | 11/1974 | Masai et al. |
| 3,899,266 | A | 8/1975 | Masai et al. |
| 3,942,906 | A | 3/1976 | Schonwald |
| 3,951,567 | A | 4/1976 | Rohs |
| 3,973,865 | A | 8/1976 | Mugele |
| 3,982,848 | A | 9/1976 | Schonwald et al. |
| 4,001,473 | A | 1/1977 | Cook |
| 4,006,998 | A | 2/1977 | Schonwald |
| 4,100,993 | A | 7/1978 | Feder |
| 4,135,603 | A | 1/1979 | Dean, III et al. |
| 4,141,674 | A | 2/1979 | Schonwald |

(Continued)

OTHER PUBLICATIONS

Lori A. Brady, "Application of the Herschel-Quincke Tube Concept to Higher-Order Acoustic Modes in Two-Dimensional Ducts", Mar. 1, 2002.

(Continued)

*Primary Examiner*—Ninh H. Nguyen
(74) *Attorney, Agent, or Firm*—Renner Kenner Greive Bobak Taylor & Weber

(57) ABSTRACT

A blower includes a blower housing having a chamber, an impeller rotatably received in the chamber, the impeller having a plurality of blades; and at least one resonator ring associated with one of the blower housing and the impeller. The resonator ring provides a plurality of resonator cavities for absorbing noise generated by the plurality of blades. The blower housing has an inlet opening and an outlet opening associated with the chamber; and a baffle assembly subdividing at least one of the inlet and the outlet openings.

23 Claims, 10 Drawing Sheets

U.S. PATENT DOCUMENTS 4,150,732 A 4/1979 Hoch et al.
4,172,678 A 10/1979 Schonwald et al.
4,174,020 A 11/1979 Challis
4,189,027 A 2/1980 Dean, III et al.
4,194,798 A 3/1980 Schonwald et al.
4,204,800 A 5/1980 Bentele et al.
4,204,802 A 5/1980 Schonwald et al.
4,247,246 A 1/1981 Abe et al.
4,253,800 A 3/1981 Segawa et al.
4,319,661 A 3/1982 Proudfoot
4,321,008 A 3/1982 McCoy
4,325,672 A 4/1982 Sixsmith et al.
4,376,613 A 3/1983 Schoenwald
4,412,781 A 11/1983 Abe et al.
4,456,423 A 6/1984 Mittmann
4,483,656 A 11/1984 Abe et al.
4,562,900 A 1/1986 Anderson et al.
4,657,481 A 4/1987 Mowill et al.
4,749,338 A 6/1988 Galtz
4,932,833 A 6/1990 Wieja et al.
4,932,834 A 6/1990 Galtz et al.
4,944,310 A 7/1990 Sullivan
4,944,362 A 7/1990 Motsinger et al.
4,992,021 A 2/1991 Langen et al.
4,992,022 A * 2/1991 Aust et al. ..... 415/121.2
5,000,660 A 3/1991 Van Houten et al.
5,040,943 A 8/1991 Dwyer et al.
5,120,193 A 6/1992 Kadle et al.
5,143,511 A * 9/1992 Verneau et al. ..... 415/55.4
5,161,941 A 11/1992 Ratner
5,244,352 A 9/1993 Mugele
5,281,083 A 1/1994 Ito et al.
5,302,081 A * 4/1994 Smith ..... 415/55.1
5,340,275 A 8/1994 Eisinger
5,395,210 A 3/1995 Yamazaki et al.
5,484,259 A 1/1996 Ahmed et al.
5,499,900 A 3/1996 Khmara et al.
5,527,148 A 6/1996 Aust et al.
5,527,149 A 6/1996 Moss et al.
5,527,150 A 6/1996 Windhofer
5,536,139 A 7/1996 Yamazaki et al.
5,569,023 A 10/1996 Ishida et al.
5,658,126 A 8/1997 Werner et al.
5,697,152 A 12/1997 Yamazaki et al.
5,700,983 A 12/1997 VonDross
5,718,561 A 2/1998 Fischer
5,791,870 A 8/1998 Alexander
5,964,573 A 10/1999 Fischer
5,987,729 A 11/1999 Moran
6,019,571 A 2/2000 Fischer
6,039,532 A 3/2000 McConnell
6,142,728 A 11/2000 Humburg et al.
6,146,092 A 11/2000 Botros et al.
6,896,095 B1 5/2005 Shah et al. ..... 181/198
2004/0071546 A1 4/2004 Werner et al. ..... 415/119

OTHER PUBLICATIONS

G.M. Diehl, "Think Quiet", Compressed Air, 1971, pp. 1-34.
Johann Liljencrants, "Working of Acoustic Resonators", Mechanical Music Digest, Jun. 23, 2001, pp. 1-2.
Larry Hanson, "Hybrid Circuit Technology", Nov., 1984, Lake Publishing Corp.
Ahmet Selamet, "New Tools Helps Automakers Silence Irritating Noise", http://researchnews.osu.edu/archive/whistle.htm, Apr. 1, 2002.
"Effectiveness of Adjacent Reactive Absorbers" , Mar. 27, 2000; http://www.deicon.com/technote/adjacent_resonators_deicon.pdf.
Y.P. Soh, E.W.T. Yap and B.H.L. Gan, "Industrial Resonator Muffler Design", 2001; http://www.mecheng.adelaide.edu.au/courses/undergrad/projects/level4papers2001/soh$_{13}$ yap_gan.pdf.
J.W. Mooney, "Helmholtz Resonator Sound Absorbers", Apr. 2000; http://www.jwmooney.com/wcpub/page45.html.
"Helmholtz Resonance" 2000, Modified on Jun. 19, 2003 by Joe Wolfe BSc Qld, BA UNSW, PhD ANU. University of New South Wales Sydney, Australia, http://www.phys.unsw.edu.au/jw/Helmholtz.html.
Fuji Ring Compressors Published in 1996 in the Fuji Blowers product catalog by Fuji Electric Company. Web page address for updated catalog: http://www.airpowerproducts.com/fuji/index.shtml#operation.
"Noise Control, Sound Behavior", Nov. 1991,National Occupational Health and Safety Commission (NOHSC) Australian Government, http://www.nohsc.gov.au/OUSInformation/OHSSolutions/noise/SOUNDA.HTM.
"Sound Cell", 2002 Proudfoot Company website catalog, http://www.soundblox.com/scell.htm.
John S. Lamancusa, "Fan Noise Prediction" Jul. 12, 200, "Fan Noise",http://www.me.psu.edu/lamancusa/me458/11_fan.pdf.
Thomas B. Greensdale Jr., "Helmholtz Resonator", 1966; http://physics.kenyon.edu/EarlyAppartus/Rudolf_Koenig_Apparatus/Helmholtz_Resonator.

* cited by examiner

VORTEX BLOWER HAVING HELMHOLTZ RESONATORS AND A BAFFLE ASSEMBLY

TECHNICAL FIELD

Generally, the present invention is directed to blower assemblies. More particularly, the present invention is directed to blower assemblies with noise reducing features. Specifically, the present invention is directed to a blower assembly which provides a Helmholtz resonator configuration associated within the blower assembly's impeller and a baffle assembly associated with the assembly's housing.

BACKGROUND ART

Industrial blowers are well known in the industry for efficiently generating large quantities of air flow. This air flow is used for generating an air flow in industrial processes or generating a suction or vacuum force. Such applications include, but are not limited to: air-assisted breathing; air-assisted inflation or support for material handling, paper processing, floatation tables; air-assisted vacuum pick-up or hold-down; air and gas sampling, boosting or circulating; electronic cooling; gas, vapor and fume recovery, venting and treatment; solid material transportation, separation and collection; parts blow-off and drying; solution and media agitation, and aeration. These blowers, and machinery in general, create lots of noise which are considered by many to be a form of pollution. Prolonged exposure to high levels of noise can damage an individual's hearing and is considered to be generally uncomfortable at lower levels. It will also be appreciated that the noise generated by these machines contribute to inefficiency in the operation of the machine and lead to premature wear and a waste of energy.

Prior art blower assemblies typically employ an electric motor that rotates a shaft that is connected to an impeller or fan. The impeller is contained within a blower housing that forms an enclosed annular chamber. Fluidly connected with the annular chamber is an inlet port and an outlet port. As the motor is energized, air is drawn in the inlet port by the impeller, pressurized and then expelled out the outlet port. In particular, the impeller blades pass the inlet port and draw air or other gases into the blower. The impeller blades then, by centrifugal action, accelerate the air outward and forward. Depending upon the construction of the impeller and the annular chamber a "regenerative" principle may take effect so that the air is turned back by the annular shaped housing to the base of the following blades where it is again hurled outward. Each "regeneration" imparts more pressure to the air. When the air reaches a "stripper" section at the outlet, wherein the stripper is the part of the housing located between the inlet and the outlet in which the annulus is reduced in size to fit closely to the sides and tips of the impeller blades, the air is "stripped" from the impeller and diverted out of the blower. The pressures or vacuums generated by the one or multiple spinning, non-contacting impellers are equal to those obtained by many larger multi-stage or positive displacement blowers.

Although these blowers are effective in generating a desired pressure or air flow it will be appreciated that a significant amount of noise is also generated. It is believed that the noise is primarily generated by the impeller blades passing by the edges of the housing and the sharp airflow turns encountered in routing the air through the inlet, the annular chamber and the output port. A significant noise source is sometimes referred to as a "blade passing frequency" which is generated by the impeller blades passing a fixed point such as the housing or stripper section. This frequency may be estimated by the number of impeller blades, times the impeller's revolutions per minute, divided by 60 (seconds per minute). This frequency varies with blower speed and environmental changes to the speed of sound. Additional features of the impeller, such as strength ribs, may generate additional noise components. Harmonics of these prime noise generators also contribute to the overall noise of the blower. It is known to provide internal baffles and noise absorbing foam at the inlets and outlets but these are not directly associated with the source of the noise. Therefore, there is a need in the art for a more direct sound absorbing or noise minimizing feature associated with the source of the noise. And there is also a need to improve airflow properties through the blower so as to reduce turbulence so as to further reduce generated noise.

SUMMARY OF THE INVENTION

It is thus an object of the present invention to provide a vortex blower having Helmholtz resonators and a baffle assembly associated therewith.

Another object of the present invention, which shall become apparent as the detailed description proceeds, is achieved by a blower comprising a blower housing having a chamber; an impeller rotatably received in the chamber, the impeller having a plurality of blades; and at least one resonator ring associated with one of the blower housing and the impeller, the resonator ring having a plurality of resonator cavities for absorbing noise generated by the plurality of blades.

Other aspects of the present invention are attained by a blower comprising a motor having a rotatable shaft; a blower housing having a chamber, the blower housing having an inlet opening and an outlet opening; an impeller secured to the shaft and received in the blower housing; and a baffle assembly sub-dividing at least one of the inlet and the outlet openings.

These and other objects of the present invention, as well as the advantages thereof over existing prior art forms, which will become apparent from the description to follow, are accomplished by the improvements hereinafter described and claimed.

BRIEF DESCRIPTION OF THE DRAWINGS

For a complete understanding of the objects, techniques and structure of the invention, reference should be made to the following detailed description and accompanying drawings, wherein.

BEST MODE FOR CARRYING OUT THE INVENTION

Figure 1:
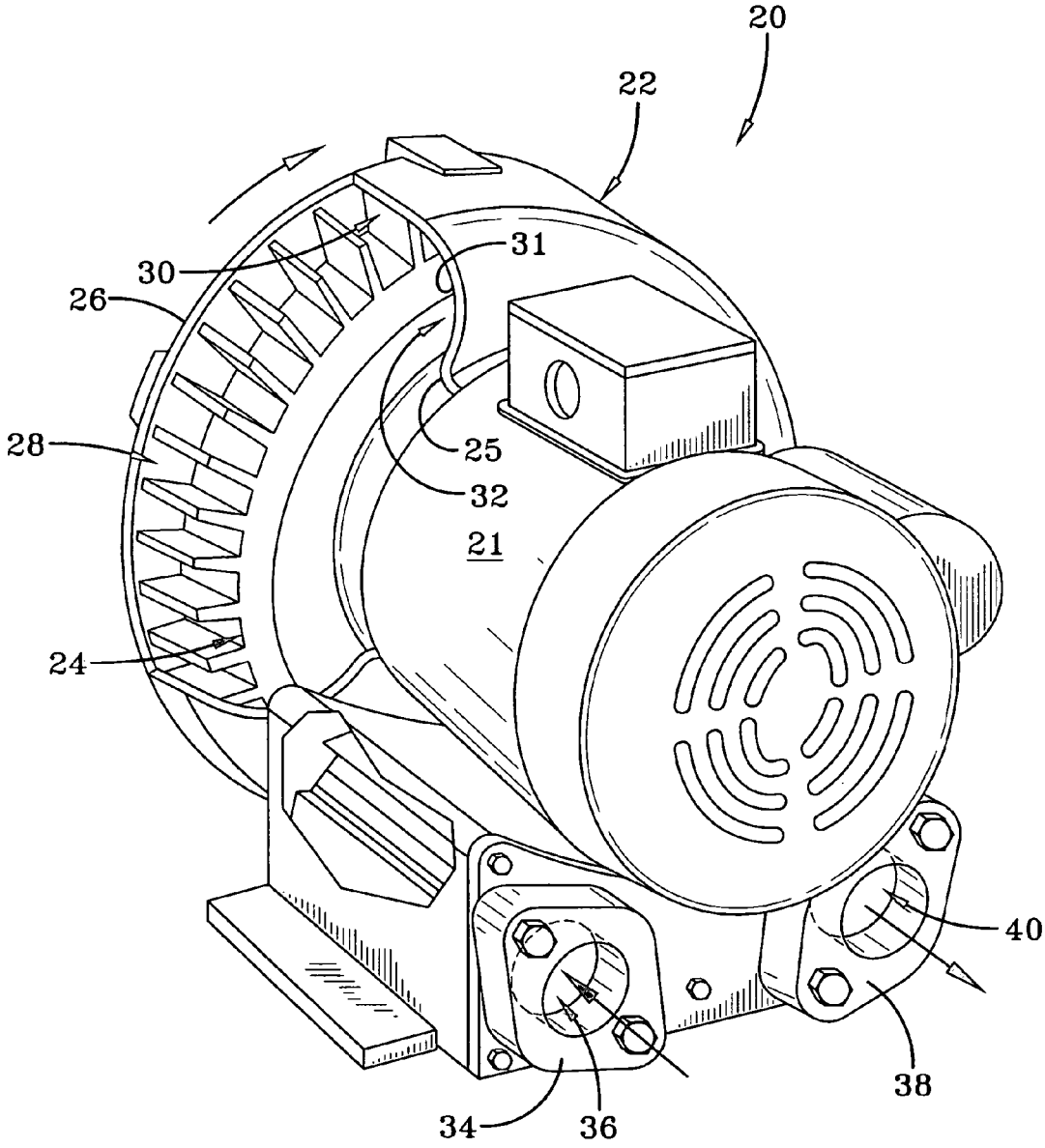
FIG. 1 is a perspective view of a blower assembly in partial cross-section according to the present invention.

Referring now to the drawings and in particular to FIG. 1 it can be seen that a blower assembly according to the present invention is designated generally by the numeral 20. The blower assembly includes a motor 21 which is associated with an blower housing 22. Received within the blower housing 22 is an impeller 24, sometimes referred to as a fan, and which is generically shown in FIG. 1. The inventive impeller is shown in FIGS. 2–6.

Figure 12:
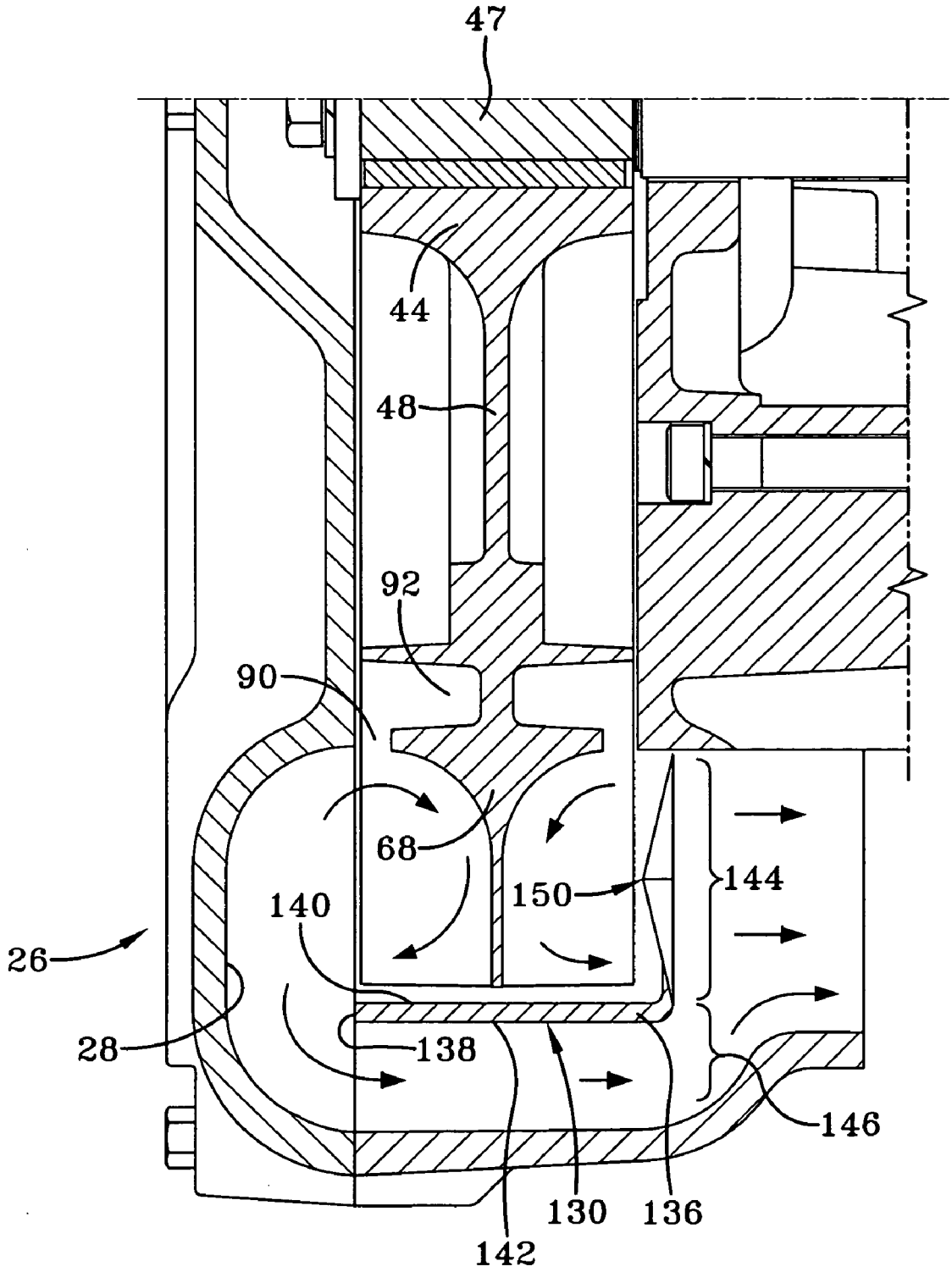
FIG. 12 is a schematic drawing illustrating airflow properties of the impeller and the associated baffle assembly.

The blower housing 22 includes an interior motor endbell 25 which is positioned approximately near the motor 21. A rotatable shaft extends from the motor and is journalled in the motor endbell 25 with appropriate bearings and extends into the impeller housing 22 and is secured to the impeller. A blower cover 26 is secured to the blower housing 22 for the purpose of at least partially enclosing the impeller 24. The blower cover 26, which is also seen in FIG. 12, includes an annular channel 28 which accommodates airflow generated by the rotating impeller. Indeed, the blower cover 26 and the blower housing 22 form a chamber 30 for receiving the entire impeller 24. And the motor endbell 25 includes an annular channel 31 shaped much like the channel 28. Together, the channels 28 and 31 form a toroidal cavity 32 which is disposed about the outer periphery of the chamber 30. The blower assembly 20 includes an inlet 34 which provides an inlet opening 36 that is contiguous with the toroidal cavity 32. The blower also provides an outlet 38 which provides an outlet opening 40 that is also contiguous with the toroidal cavity. As previously described, upon rotation of the motor shaft, the impeller is likewise rotated and the impeller draws air in through the opening 36. The air is propelled and pressurized through the toroidal cavity 32 and exhausted out the opening 40. It will be appreciated that the openings 36 and 40 are sized to cooperate with the toroidal cavity 32 so as to provide generation of a maximum amount of airflow. Moreover, the outlet opening 40 is configured so as to closely surround the rotating impeller to allow for removal of the air generated by the impeller's rotation. In other words, the outlet 38 "strips" the airflow generated within the toroidal cavity and exhausts the airflow out the opening 40.

Referring specifically now to FIGS. 2–6 it can be seen that the impeller is designated generally by the numeral 24. The impeller 24 includes a central hub 44 which has a shaft hole 46 extending therethrough. A shaft 47 is secured into the shaft hole 46 by well known means. Radially extending from the hub 44 is a disc 48. A balance ring 52 extends radially from the disc 48 and is of a substantially larger thickness than the disc 48 to provide structural support to and balancing to the impeller 24. The balance ring 52 includes a wall 54 and a face surface 56 which is substantially perpendicular to the wall 54. A plurality of spokes or ribs 58 extend radially from the hub 44 along the disc 48 to the wall 54. The ribs 58 provide structural support to the impeller 24. It will further be appreciated that the impeller is of a substantially symmetrical construction such that the spokes 58 are provided on both sides of the impeller. A boss 60 may be provided at the radial ends of selected spokes 58 about the collar wall 54. Each boss 60 may have a boss hole 62 extending therein.

A resonator ring 66 radially extends from the balance ring 52 and is provided on both sides of the impeller. Details of the resonator ring and its theory of operation will be discussed in detail upon a complete description of the impeller 24. Extending radially outwardly from the resonator ring 66 is a fillet 68 which radially transitions into a blade ring 70.

The blade ring 70 includes a fin 74 which extends radially from the resonator ring 66 and the fillet 68. A plurality of radially spaced blades 76 perpendicularly extend from both sides of the fin 74 and the resonator ring 66. It will be appreciated that the fin in the present embodiment extends all the way to the end of the blades but that this is not required for the purpose of practicing the invention. The blade 76 includes a proximal portion 78 immediately adjacent the resonator ring 66 and a distal portion 80 which extends from the proximal portion 78 to the outer periphery of the impeller. Adjacent blades 76 form a blade gap 82 therebetween. It will further be appreciated that the proximal portion 78 is angularly distinguishable from the distal portion 80. It is believed that this variation in angle from the proximal portion 78 to the distal portion 80 improves the air flow generation properties of the impeller 24.

The resonator ring 66, as previously discussed, is radially positioned between the balance ring 52 and the blade ring 70. The resonator ring 66 includes a facing surface 86 which faces axially outwardly from the surface of the impeller 24. The facing surface 86 includes a plurality of resonator cavities 88which are embedded in the ring 66. The cavities 88 include a neck 90 which fluidly is open to the blade gap 82 and a pocket 92 which is contiguous or fluidly associated with the neck 90. It will be appreciated that the resonator cavities 88 on each side of the resonator ring are associated with a corresponding blade gap. Although only one resonator cavity is shown for each blade gap on each side of the impeller, it will be appreciated that multiple resonator cavities could be provided in association with each gap. Indeed, multiple and different size resonator cavities could be provided on each side of the blade gap to absorb different ranges of noise frequencies generated by the blades and any other noise frequencies generated by rotation of the impeller within the blower housing.

Figure 4:
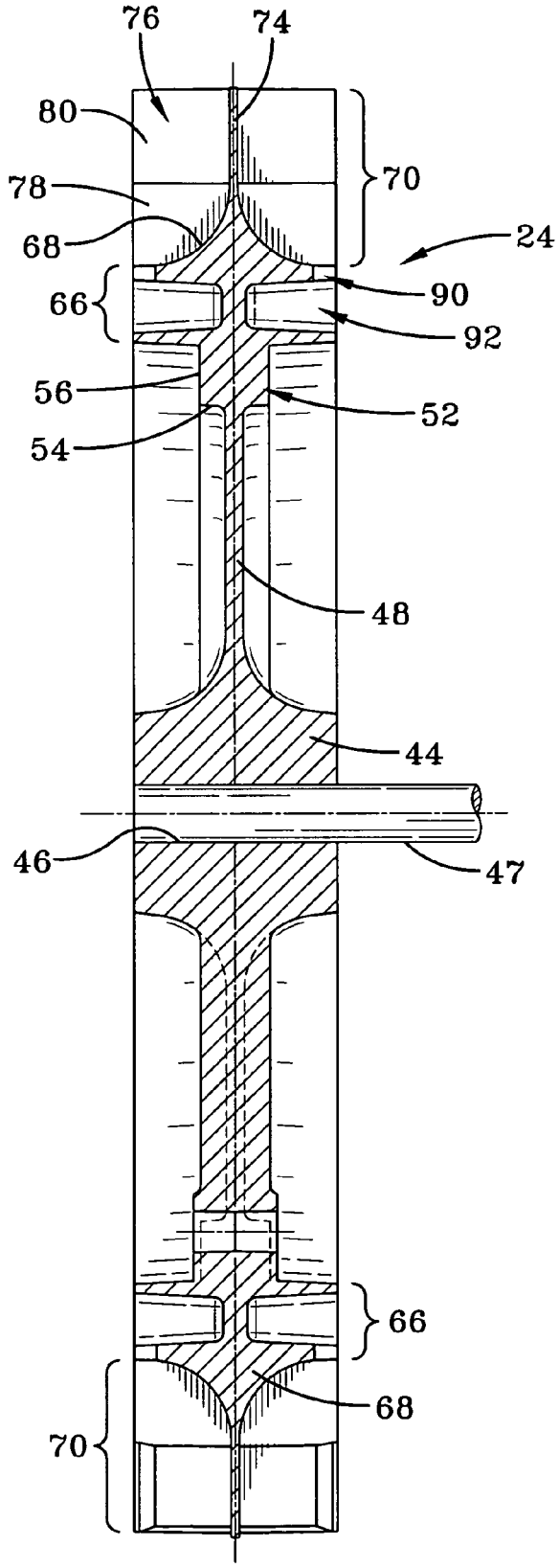
FIG. 4 is a cross-sectional view of the impeller taken along lines 4—4 of FIG. 3.
Figure 5:
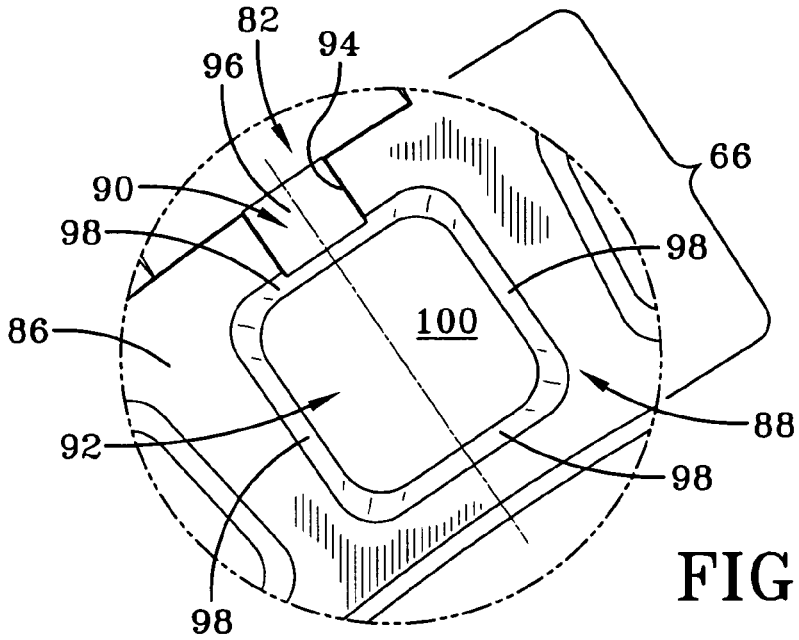
FIG. 5 is a detailed view of a resonator cavity employed with the impeller according to the present invention.
Figure 6:
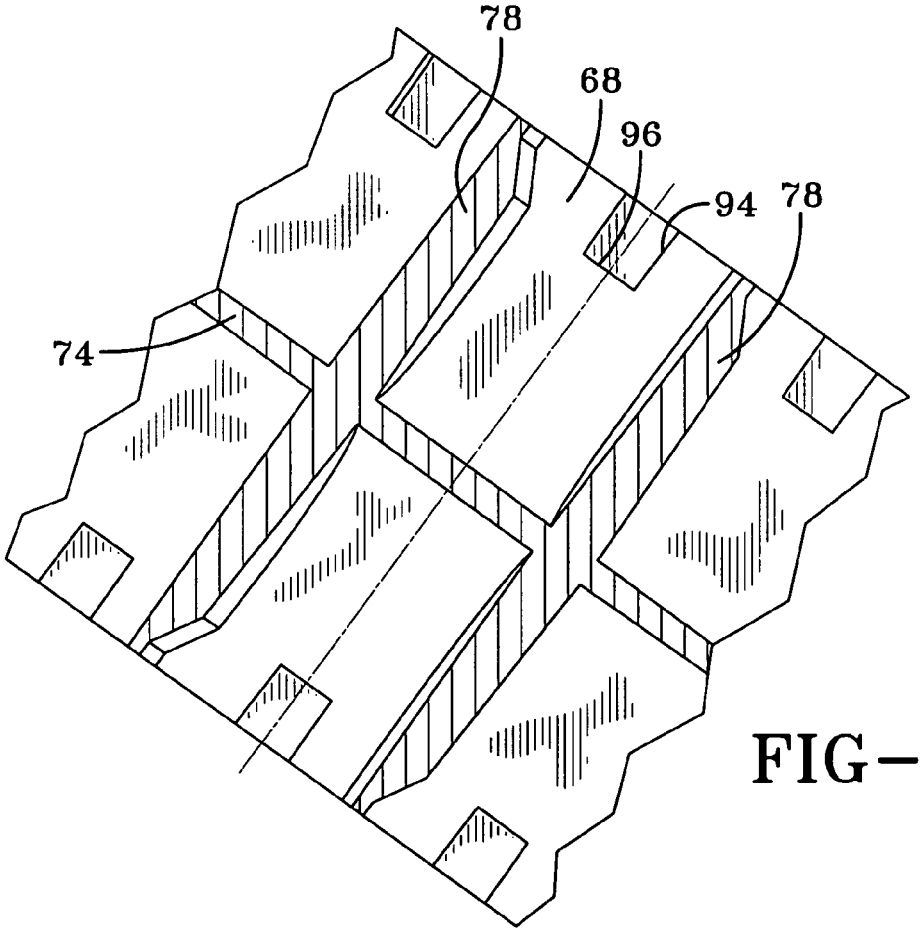
FIG. 6 is a selected cross-sectional view of the resonator cavity taken along lines 6—6 of FIG. 3.
Figure 7:
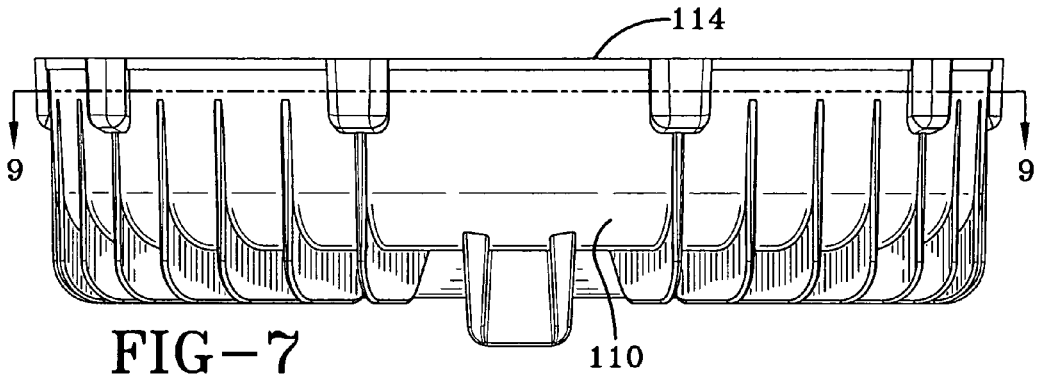
FIG. 7 is a top view of a blower housing in accordance with the concepts of the present invention.
Figure 8:
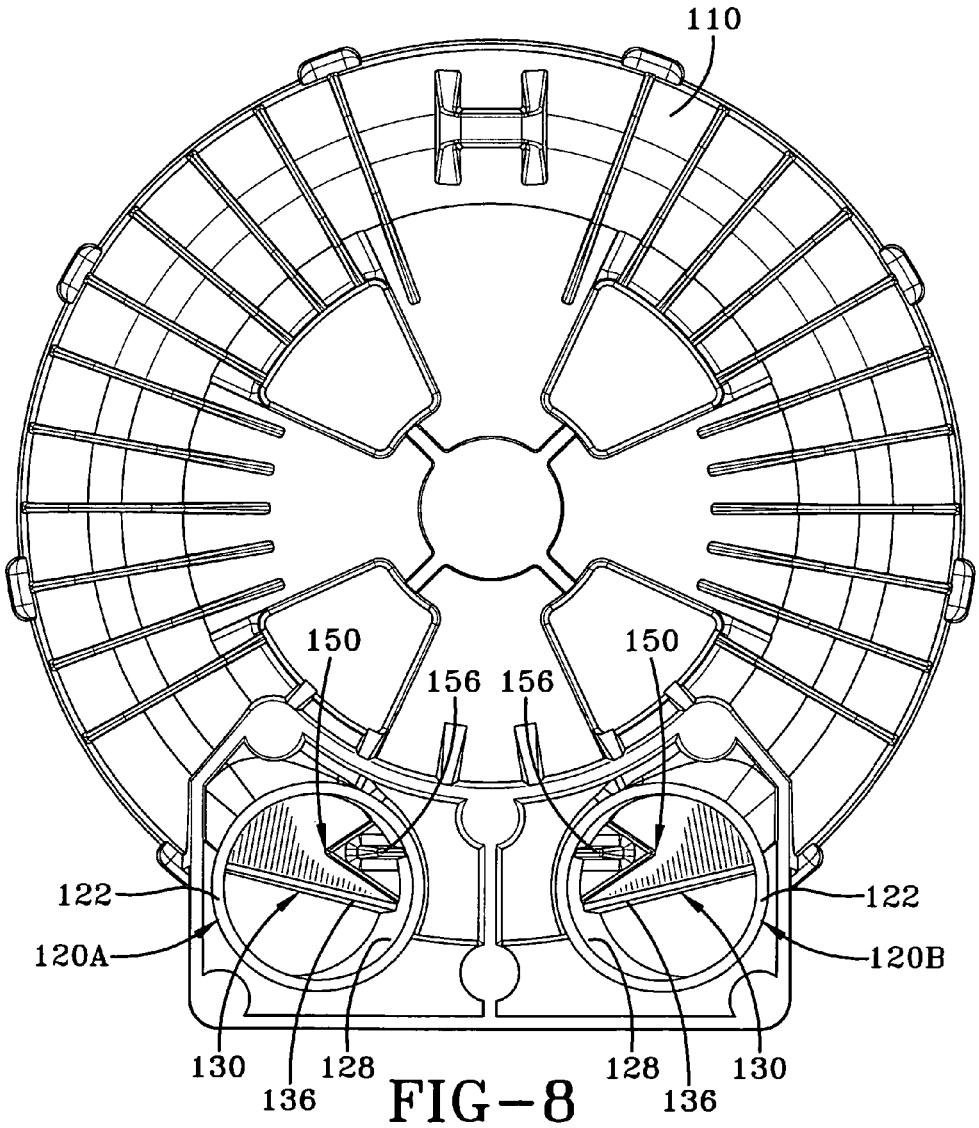
FIG. 8 is an elevational view of the blower housing as viewed from the motor side of the blower housing with the impeller removed.

As best seen in FIGS. 4–6, the resonator cavity 88 includes the neck 90 which is a relatively shallow portion that includes neck sides 94 and a neck bottom 96 that is substantially perpendicular to the neck sides. The pocket 92, which is relatively larger than the neck, is formed by a plurality of pocket sides 98 that are substantially perpendicular to a pocket bottom 100. If desired, the pocket sides 98 and the neck sides 94 may taper inwardly from the surface 86 such that the neck and pocket are somewhat larger at the surface than at their respective bottoms 96 and 100.

The resonator cavities 88 are loosely configured upon Helmholtz resonators to absorb noise generated by rotation of the impeller. As the impeller blades pass a surface or edge, especially around the outlet area, the shearing of the air generates noise at a predetermined frequency. Without the benefit of the resonators this noise is reflected and primarily exits out the inlet port or opening. The noise may also exit out the outlet port, or be absorbed into the cover or housing and generate vibration and noise therethrough. In any event, the noise or sound waves generated by the rotating impeller initiates an absorbing cycle of the resonator cavities. The noise propagates between the blades, through the neck and is received within the pocket whereupon it is dissipated. In general, the air within the volume formed by the pocket functions as an equivalent compliant (spring) element and the air within the volume formed by the neck functions as a mass element. The cavity is sized according to the equation $$F = \frac{c}{2\pi}\sqrt{\frac{S}{LV}}$$

where F=frequency
c=speed of sound
S=area of neck
L=length of neck
V=volume of pocket By adjusting the variables S, L and V, one can "tune" the resonator cavity to absorb the blade passing frequency. Adjustments may also be made in view of the ambient conditions that affect the speed of sound constant. As the blade passing frequency is generated, a low acoustic impedance at the neck is produced and the sound level will drop as the sound pressure is "shorted out." However, within the pocket, the sound level increases and is converted into heat energy that is dissipated. Accordingly, the specific frequency blade passing sounds generated by the impeller blade are absorbed.

By providing different size resonator cavities within the resonator ring, a wider range of frequencies may be absorbed. Since the impeller is typically made from a casting process it is believed that sizing the cavities to be approximately the same size provides the most benefit. However, a more complex resonator ring may also be utilized to absorb a wider range of frequencies. Indeed, the resonator ring may be incorporated into the cover facing the impeller or the motor wall housing facing the other side of the impeller. However, it is believed that the resonator cavities are best situated on the impeller in view of the fact that the blade passing the stripper or outlet section of the housing is where most of the noise is generated. And by associating the resonator cavity in close proximity to the area where the noise is generated, the best noise level reduction is obtained.

Figure 2:
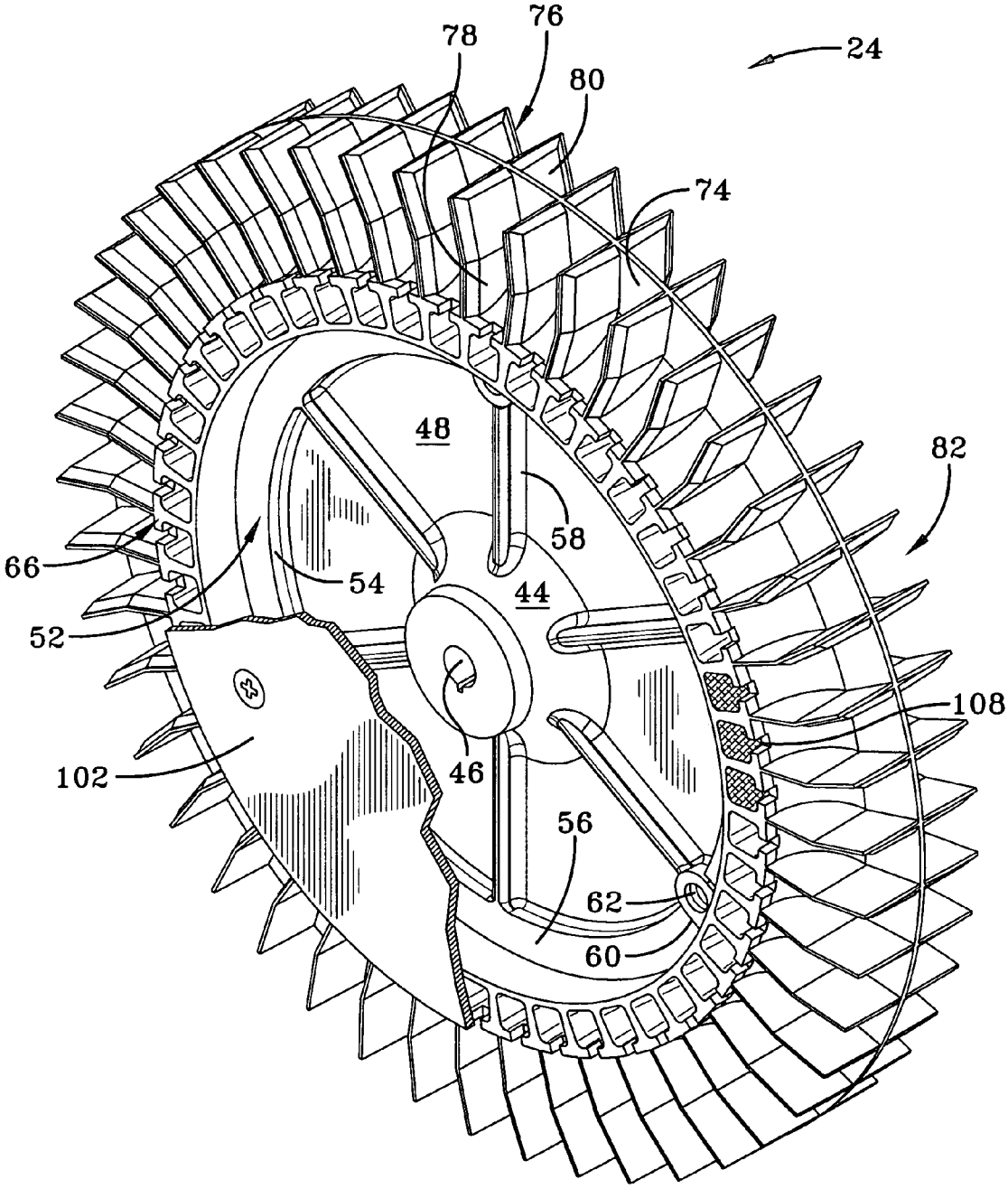
FIG. 2 is front perspective view of an impeller employed in the blower assembly according the present invention.
Figure 3:
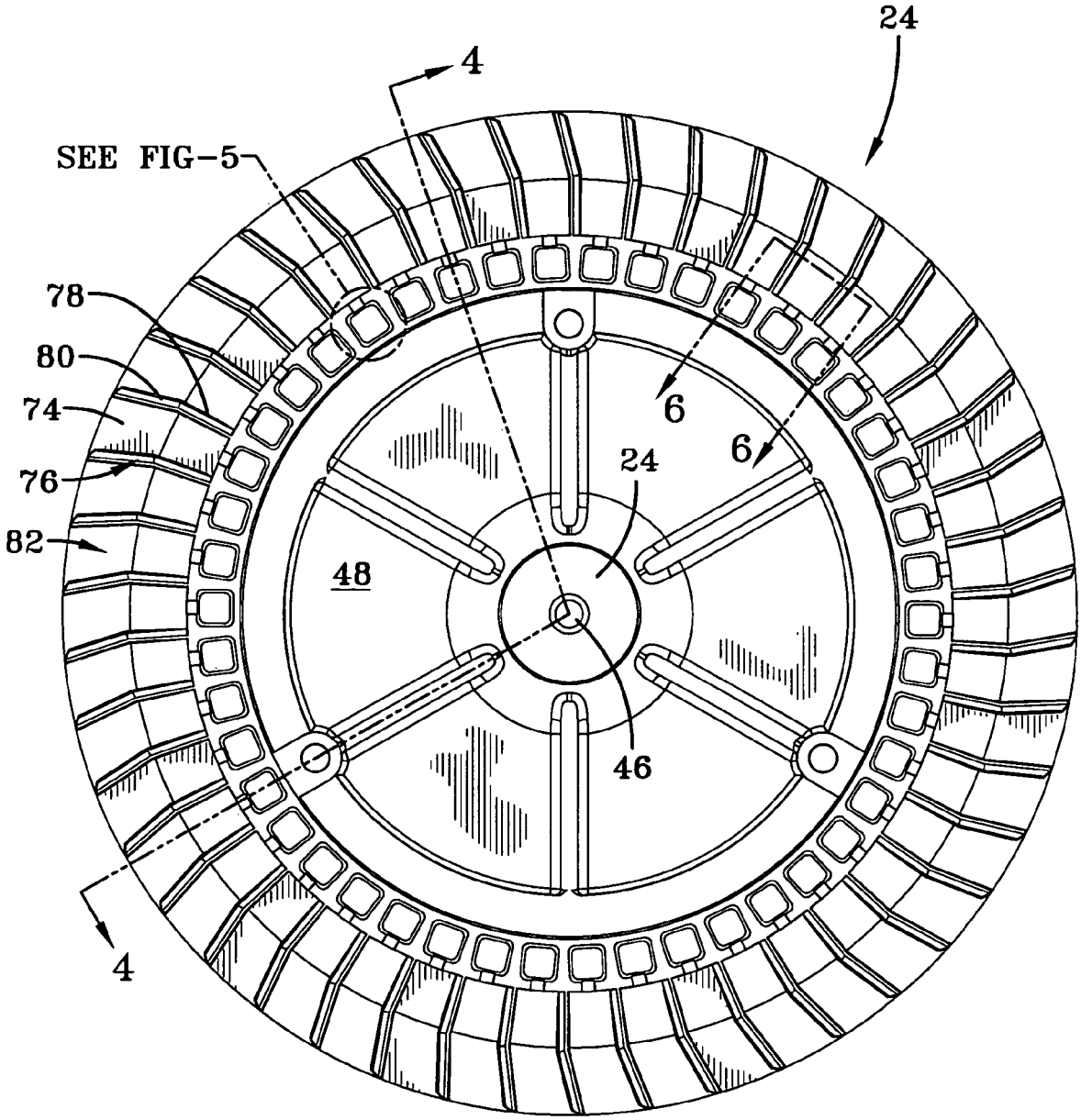
FIG. 3 is an elevational view of the impeller.

Yet another noise reducing feature of the present impeller is by utilizing ribs that are reduced in size with respect to the collar surface 56. Indeed, by minimizing the height of the spokes 58 with respect to the collar face surface, the generation of a blade passing frequency by the spokes is significantly reduced. As an alternative to reducing the size of the thickness or height of the spokes 58, it is believed that a ring plate 102 may be employed. The ring plate 102, which is best seen in FIG. 2, provides a plurality of plate holes 104 which are aligned with corresponding boss holes 62. Fasteners 106 secure the ring plate 102 to the impeller for the purpose of at least partially enclosing the resonator ring 66. In this way, the spokes do not generate a blade passing frequency. Moreover, by partially enclosing the resonator cavities 88, the noise generated by the rotating blades enters the neck 90 and is completely retained within the pockets 92 for further noise reduction. Although the ring plate is shown as covering the resonator ring, the disc, it will be appreciated that the ring plate could be shaped like a ring and just cover the reasonator ring 66. Yet a further reduction of noise may be employed by incorporating damping or noise absorbing material 108 within the pocket 92. The material 108 may be used in conjunction with or without the ring plate 102. Although any type of material may be used as damping material it is believed that felt provides the optimal sound absorption properties.

A further noise reducing feature of the blower assembly 20 can be seen in FIGS. 7–12. In particular, it can be seen that the housing 22 includes a housing wall 110 which provides an interior surface 112. Extending substantially perpendicularly from the interior surface is a rim 114. The cover 26 (FIG. 1) is attached to the rim 114 utilizing fasteners, welding, clamps or the like. As discussed previously, the housing wall provides an inlet 34 and an outlet 38 with corresponding openings. Incorporated into each inlet and outlet opening is a baffle assembly designated generally by the numeral 120. It will be appreciated that the baffle assembly associated with the inlet may be designated as 120A and the baffle assembly associated with the outlet may be designated as 120B. Although both baffle assemblies are substantially the same in construction, any differences between the two may be designated by an appropriate suffix, wherein the A suffix refers to the inlet and the B suffix refers to the outlet. In any event, the inlet/outlet may define a sleeve 122 which surrounds the respective opening and extends from the housing wall 110 toward the toroidal cavity 32. Each sleeve 122 or respective opening includes a sleeve edge 126 which is in relatively close proximity to the edges of the blades. In other words, the sleeve edges 126 are in juxtaposition to the facing surface of the impeller and in particular the rotating blades. The sleeve 122 or respective opening also includes an interior wall 128 which is substantially perpendicular with the sleeve edge 126. The diameter of the sleeve 122 corresponds to the effective diameter of the toroidal cavity so as to provide a smooth transitional airflow pattern with respect to the inlet/outlet.

Figure 10:
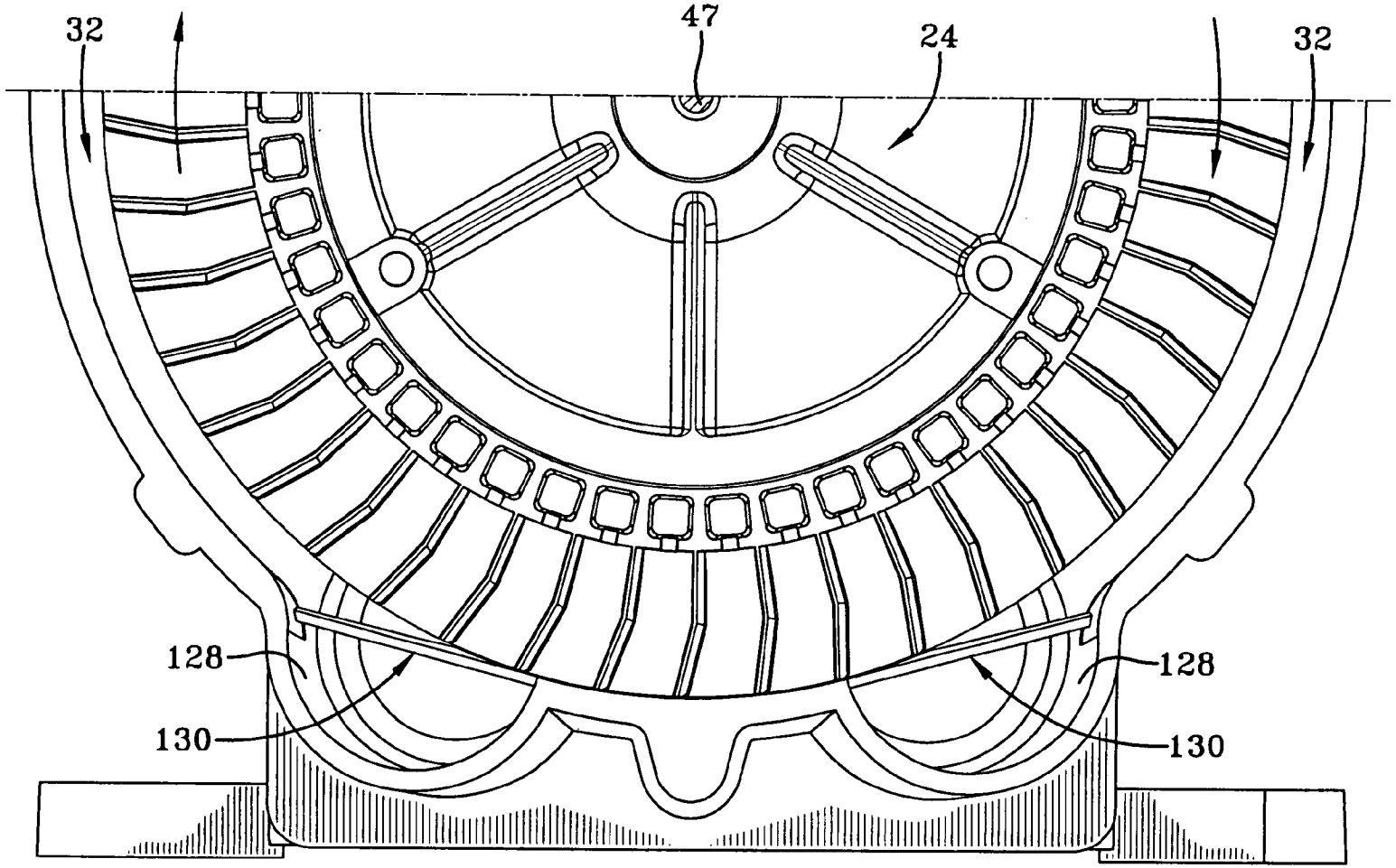
FIG. 10 is a partial elevational view of the blower housing as viewed from a housing cover with the impeller installed.

The baffle assembly 120 includes a baffle plate 130 which substantially bisects or sub-divides the respective opening. In particular, the plate 130 is configured so as to be substantially aligned with the outer periphery of the impeller blades as they rotate. The baffle plate 130, as best seen in FIG. 10, includes a wide edge 132 connected to one side of the interior wall 128 opposite a narrow edge 134 connected to a substantially opposite side of the interior wall. And the baffle plate includes a housing edge 136 which is the leading edge of the plate contacting the inflow of air and the trailing edge of the plate exiting the outflow of air. Opposite the housing edge 136 is an impeller edge 138 that is closest in proximity to the rotating impeller. The baffle plate 130 includes a blade side 140 that is facing the outer periphery of the impeller. The opposite side of the baffle plate is a sleeve side 142 which faces away from the impeller. It will be appreciated that the baffle plate 130 defines a primary flow aperture designated generally by the numeral 144 which is within a cylinder defined by the periphery of the impeller and by the blade side facing the interior wall and a secondary flow aperture 146 which is defined by the baffle plate sleeve side 142 facing the interior wall 128. In other words, the primary flow aperture is the upper half of the inlet/outlet while the secondary flow aperture is defined by the bottom portion of the corresponding inlet or outlet.

Figure 9:
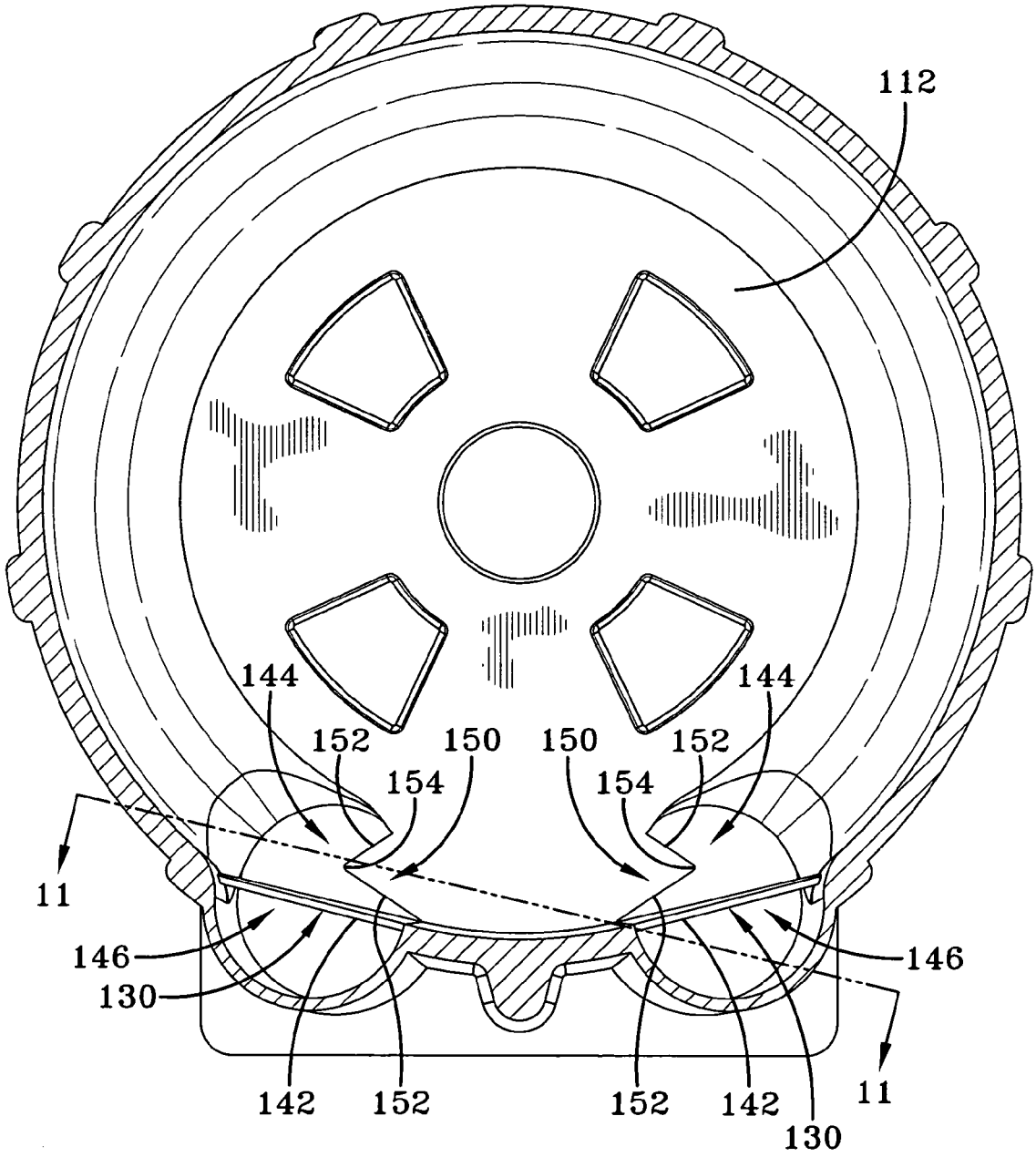
FIG. 9 is a cross-sectional view of the blower housing taken along lines 9—9 of FIG. 7.
Figure 11:
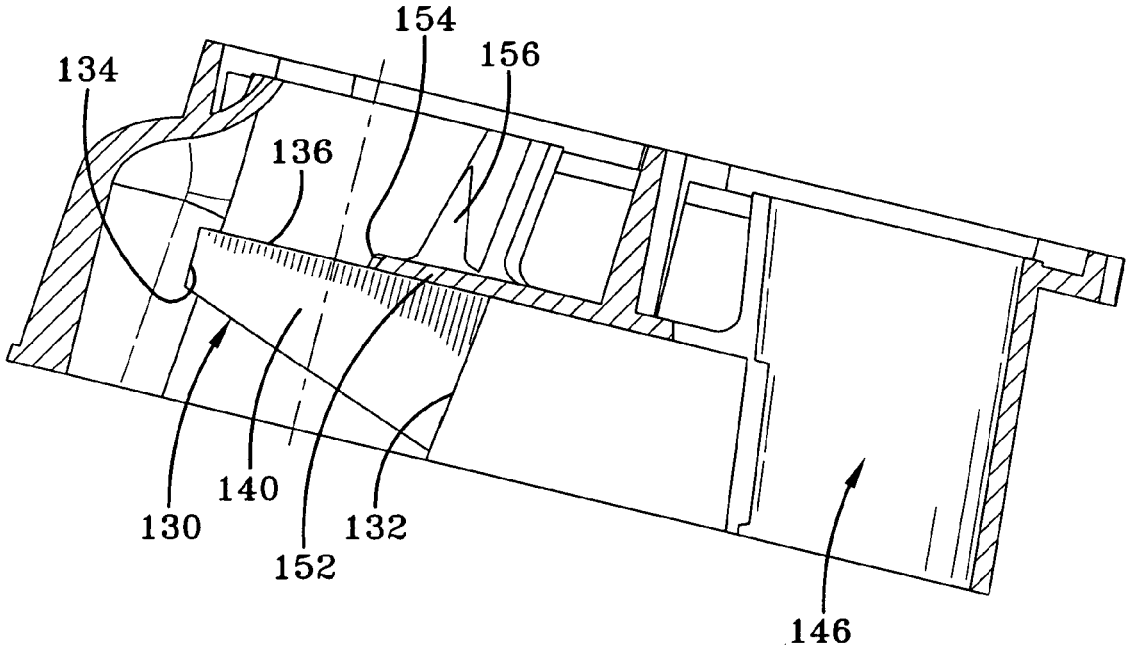
FIG. 11 is a cross-sectional view taken along lines 11—11 of FIG. 9 illustrating a baffle assembly employed in the input and output ports of the housing.

Another component of the baffle assembly is a baffle wing 150, best seen in FIGS. 9 and 11, which assists in redirecting the airflow in an efficient manner. The baffle wing 150 extends from the interior wall 128 into the primary flow aperture. The wing 150 incorporates a pair of wing edges 152 which converge into a wing tip 154. It is believed that in the preferred embodiment the wing 150 is of a substantially triangular configuration although other wing configurations could be incorporated into the sleeve 122. The wing surface faces the rotating of the impeller blades and is supported by a wing support bracket 156 on an opposite side.

Referring specifically to FIG. 12, it can be seen that the benefits of the baffle assembly are readily apparent. In particular, the taper configuration of the baffle allows for a primary flow of air to be generated and exit from the impeller blades as it enters the outlet opening. The baffle plate allows for air recirculating in the channel of the toroidal cavity to circulate therein and then exit underneath the baffle plate through the secondary flow aperture. It is believed that without the baffle plate configuration that the end of the impeller blade would be closely adjacent the housing. This would facilitate the cupping of air within the toroidal cavity in this area and as such it would be difficult for air to properly exit the outlet (or be received in the inlet). By employing the wing and the tapered configuration of the baffle plate, the flow of air is greatly enhanced so as to improve the airflow properties and reduce inefficiencies in prior art blower configurations. And, the air flowing through toroidal cavity does not need to be forced through the airstream generated by the impeller. Accordingly, this allows the pressure, suction and flow to increase while reducing power consumption, heat and noise.

Based upon the foregoing, the advantages of the present invention are readily apparent. By manufacturing the impeller out of a cast material, the resonator cavities, the reduced height of the spokes and the association of a resonator cavity with each blade gap allows for efficient absorption of noise generated by the impeller blades as they pass the stripper or outlet section of the blower. This configuration is also advantageous inasmuch as the baffle plate assembly allows for smooth inflow and outflow of the air in an efficient manner and further reduces the noise otherwise generated. Testing shows that this configuration reduces noise of a comparable motor without the features of the present invention by approximately 10 db. Further reduction in noise is believed obtainable by the use of the ring plate and damping material within the resonator cavities. Therefore with the structural improvements noted in the impeller and associated inlet and outlet configurations of the blower assembly a significantly improved blower assembly is provided.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A blower comprising:

a blower housing having a chamber;

an impeller rotatably received in said chamber, said impeller having a plurality of blades with a blade gap therebetween; and at least one resonator ring associated with one of said blower housing and said impeller, said resonator ring having a plurality of resonator cavities fluidly connected to at least one of said blade gaps for absorbing noise generated by said plurality of blades.

2. The blower according to claim 1, wherein a number of said blade gaps corresponds to a number of said plurality of resonator cavities.

3. The blower according to claim 1, wherein said impeller comprises;

a hub; and a disc radially extending from said hub;

said resonator ring disposed between said disc and said plurality of blades.

4. The blower according to claim 3, wherein said impeller has a plurality of blades with a blade gap therebetween; and wherein each said resonator cavity is fluidly connected to one of said corresponding blade gaps.

5. The blower according to claim 4, wherein said resonator ring comprises:

a facing surface, said facing surface having said resonator cavity which comprises a neck fluidly connected to a pocket, wherein said pocket is at least somewhat larger than said neck.

6. The blower according to claim 5, wherein at least one of said resonator cavities is filled with damping material.

7. The blower according to claim 5, further comprising:

a ring plate secured to said disc and at least partially enclosing said resonator cavity.

8. The blower assembly according to claim 1, wherein said impeller has two resonator rings on each side thereof; each said resonator ring having a plurality of cavities; said impeller having a plurality of blades with a blade gap between each, wherein said plurality of cavities of each said resonator ring are fluidly connected to one of said corresponding blade gaps.

9. A blower comprising:

a motor having a rotatable shaft;

a blower housing having a chamber, said blower housing having an inlet opening and an outlet opening;

a sleeve forming each of said inlet and outlet openings, said sleeve having an interior wall;

an impeller secured to said shaft and received in said blower housing; and a baffle assembly sub-dividing at least one of said inlet and said outlet openings and comprising a baffle plate extending between substantially opposite sides of said interior wall.

10. The blower according to claim 9, wherein said baffle plate comprises:

a wide edge connected to one side of said interior wall;

a narrow edge connected to an opposite side of said interior wall;

a housing edge connecting said wide edge to said narrow edge, said housing edge facing away from said impeller; and an impeller edge connecting said wide edge to said narrow edge, said impeller edge facing said impeller.

11. The blower according to claim 10, wherein said impeller has a plurality of radially extending impeller blades, wherein said baffle plate comprises a blade side which substantially faces said impeller blades.

12. The blower according to claim 11, wherein said baffle plate sub-divides at least one of said inlet and outlet openings into a primary flow aperture and a secondary flow aperture.

13. The blower according to claim 12, wherein said chamber is substantially toroidal and has an endbell side adjacent said motor and a blower cover side away from said motor, and wherein said baffle plate primarily directs air flow generated by said impeller facing said motor side through said primary flow aperture and directs airflow generated by said impeller facing said cover side primarily through said secondary flow aperture.

14. The blower according to claim 13, further comprising:

a wing extending from said interior wall into said primary flow aperture.

15. The blower according to claim 14, wherein said wing is substantially perpendicular to said baffle plate.

16. The blower according to claim 15, wherein said wing has wing edges which converge to a wing tip, wherein said wing tip points toward said narrow edge.

17. The blower according to claim 15, further comprising:

a wing support bracket connected between said wing and said interior wall and extending toward said narrow edge.

18. The blower according to claim 9, further comprising:

a sleeve forming each of said inlet and outlet openings, said sleeve having an interior wall; and a wing extending from said interior wall and into one of said openings.

19. The blower according to claim 18, wherein said impeller has plurality of radially extending impeller blades, wherein said wing is positioned so as to primarily face said impeller blades.

20. The blower according to claim 9, wherein said impeller has a plurality of blades with a gap therebetween each of said blades, and wherein said impeller has a plurality of resonator cavities that correspond with said gaps.

21. A blower comprising:

a motor having a rotatable shaft;

an blower housing having a chamber, said blower housing having an inlet opening and an outlet opening;

an impeller secured to said rotatable shaft and received in said blower housing, said impeller having a plurality of blades with a gap therebetween and at least one resonator cavity fluidly connected with each of said gaps; and a baffle assembly sub-dividing at least one of said inlet and outlet openings.

22. A blower comprising:

a motor having a rotatable shaft;

a blower housing having a chamber, said blower housing having an inlet opening and an outlet opening;

a sleeve forming each of said inlet and outlet openings, said sleeve having an interior wall;

a wing extending from said interior wall and into said one of openings;

an impeller secured to said shaft and received in said blower housing; and a baffle assembly sub-dividing at least one of said inlet and said outlet openings.

23. The blower according to claim 22, wherein said impeller has plurality of radially extending impeller blades, wherein said wing is positioned so as to primarily face said impeller blades.

* * * * *